US007985093B2

(12) United States Patent
Luzzi et al.

(10) Patent No.: US 7,985,093 B2
(45) Date of Patent: Jul. 26, 2011

(54) TERMINATION DEVICE IMPEDANCE ASSEMBLY

(75) Inventors: Glenn J. Luzzi, Mt. Bethel, PA (US); Mario DaSilva, Roselle Park, NJ (US)

(73) Assignee: Richards Manufacturing Company, a New Jersey Limited Partnership, Irvington, NJ (US)

( * ) Notice: Subject to any disclaimer, the term of this patent is extended or adjusted under 35 U.S.C. 154(b) by 79 days.

(21) Appl. No.: 12/418,018

(22) Filed: Apr. 3, 2009

(65) Prior Publication Data

US 2009/0253289 A1 Oct. 8, 2009

Related U.S. Application Data

(60) Provisional application No. 61/042,476, filed on Apr. 4, 2008.

(51) Int. Cl.
*H01R 13/64* (2006.01)

(52) U.S. Cl. ..... 439/374; 439/801; 439/921

(58) Field of Classification Search ..... 439/801, 439/374, 921

See application file for complete search history.

(56) References Cited

U.S. PATENT DOCUMENTS

| | | | | |
|---|---|---|---|---|
| 3,980,374 | A * | 9/1976 | Fallot | 439/89 |
| 5,421,750 | A * | 6/1995 | Crotty | 439/801 |
| 6,991,484 | B2 * | 1/2006 | Luzzi | 439/181 |
| 7,234,980 | B2 * | 6/2007 | Jazowski et al. | 439/801 |
| 7,381,103 | B2 * | 6/2008 | Luzzi | 439/801 |

* cited by examiner

*Primary Examiner* — Briggitte R Hammond

(74) *Attorney, Agent, or Firm* — Stroock & Stroock & Lavan LLP

(57) ABSTRACT

An impedance assembly is provided for a termination device, disconnectable connector, or other type of joint for an electrical connection, such as an elbow, to facilitate preventing improper installation. More specifically, an impedance assembly can include an obstruction member that help prevent the insertion of a stud into a female device, such as a bushing, unless the stud is properly inserted through the aperture of the lug of the cable assembly. The obstruction member can include a flexible and/or displaceable member that can be displaced by the lug of the cable assembly. Alternatively, an impedance assembly can prevent the rotation of a female member which rotates to receive the stud of a male device. The impedance assembly can include an element that is received in a cavity, groove, etc. of the female member for preventing the rotation of the female member unless the element is removed therefrom. For example, the element can be removed from the cavity, groove, etc. upon the displacement of a displaceable member operatively connected to the element, thus permitting the female member to rotate.

11 Claims, 10 Drawing Sheets

TERMINATION DEVICE IMPEDANCE ASSEMBLY

CROSS REFERENCE TO RELATED APPLICATIONS

This application claims the benefit of U.S. Provisional Patent Application Ser. No. 61/042,476, filed Apr. 4, 2008, titled "TERMINATION DEVICE IMPEDANCE ASSEMBLY," the contents of which are incorporated herein by reference

TECHNICAL FIELD OF THE INVENTION

The present invention relates to an impedance assembly that may be used with an elbow for connecting two or more components. More particularly, the present invention relates to an impedance assembly for ensuring proper assembly of a cable and lug assembly and the elbow.

BACKGROUND OF THE INVENTION

An example of a currently available connector system includes three bores and can be used for connecting an electrical cable to various devices, for example, an apparatus such as a transformer or high voltage switch or to a second electrical cable. The cable is typically coupled to a coupling device, such as a metallic lug, to form a cable assembly. The lug typically includes an aperture which, when properly inserted into the elbow, aligns with the receiving cavity of the female device and the stud of the male device.

Drawbacks of the currently available systems include improper installation of the cable assembly with the devices being connected. A proper installation comprises a stud being inserted through the aperture of the lug and into the female mating device. However, rather than being inserted through the aperture of the lug, the stud may miss the aperture of the lug resulting in only the top portion of the lug being clamped between the mating device faces.

It is thus desirable to provide a system for ensuring proper installation of the cable assembly with the devices.

SUMMARY OF THE INVENTION

The present invention relates to an impedance assembly and a cable termination device, such as an elbow, having an impedance assembly for ensuring proper installation of a cable assembly to one or more devices. For example, the impedance assembly can include displaceable impedance members that impede the passage of a stud. More particularly, the impedance members are preferably in the gap between the cable lug and the inner wall of the elbow, thus preventing the stud from being inserted into the female device when the lug is not properly positioned within the elbow. In accordance with an embodiment of the invention, the impedance members can be moved by the lug so that the lug can be properly positioned.

In accordance with an embodiment, the impedance member can include an impedance member and a guide member, wherein the impedance member can slide along the guide member away from the lug. Alternatively, the impedance member can include one or more impedance members having one end connected to the inner wall of the elbow or a support member proximate the inner wall of the elbow. The impedance member can be urged by the lug toward the inner wall or the support member as the lug is inserted into the elbow.

Thus, it is an object of the present invention to provide an impedance assembly for ensuring proper positioning of a lug in a cable termination device.

Other objects, features, and characteristics of the present invention, as well as the methods of operation and functions of the related elements of the structure, and the combination of parts and economies of manufacture, will become more apparent upon consideration of the following detailed description with reference to the accompanying drawings, all of which form a part of this specification.

BRIEF DESCRIPTION OF THE DRAWINGS

A further understanding of the present invention can be obtained by reference to a preferred embodiment set forth in the illustrations of the accompanying drawings. Although the illustrated embodiment is merely exemplary of systems for carrying out the present invention, both the organization and method of operation of the invention, in general, together with further objectives and advantages thereof, may be more easily understood by reference to the drawings and the following description. The drawings are not intended to limit the scope of this invention, which is set forth with particularity in the claims as appended or as subsequently amended, but merely to clarify and exemplify the invention.

For a more complete understanding of the present invention, reference is now made to the following drawings in which:

FIG. 9 is a front view of the impedance assembly of FIG. 8;

FIG. 10 is a perspective view of the impedance assembly of FIG. 8;

DETAILED DESCRIPTION OF PREFERRED EMBODIMENTS

A detailed illustrative embodiment of the present invention is disclosed herein. However, techniques, systems and operating structures in accordance with the present invention may be embodied in a wide variety of forms and modes, some of which may be quite different from those in the disclosed embodiment. Consequently, the specific structural and functional details disclosed herein are merely representative, yet in that regard, they are deemed to afford the best embodiment for purposes of disclosure and to provide a basis for the claims herein, which define the scope of the present invention. The following presents a detailed description of preferred embodiments of the present invention.

Figure 1:
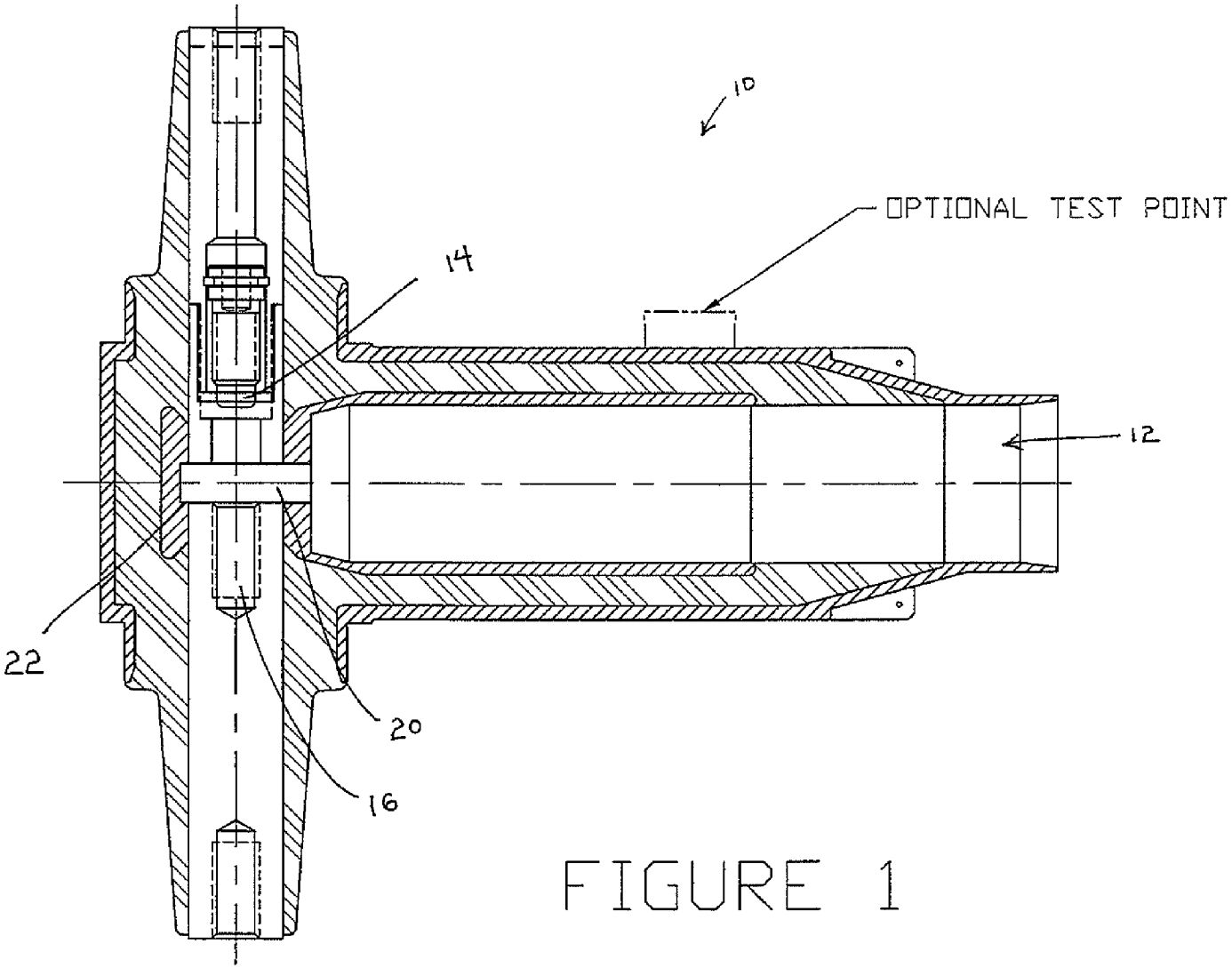
FIG. 1 is a side view of an elbow in accordance with an embodiment of the invention.
Figure 2:
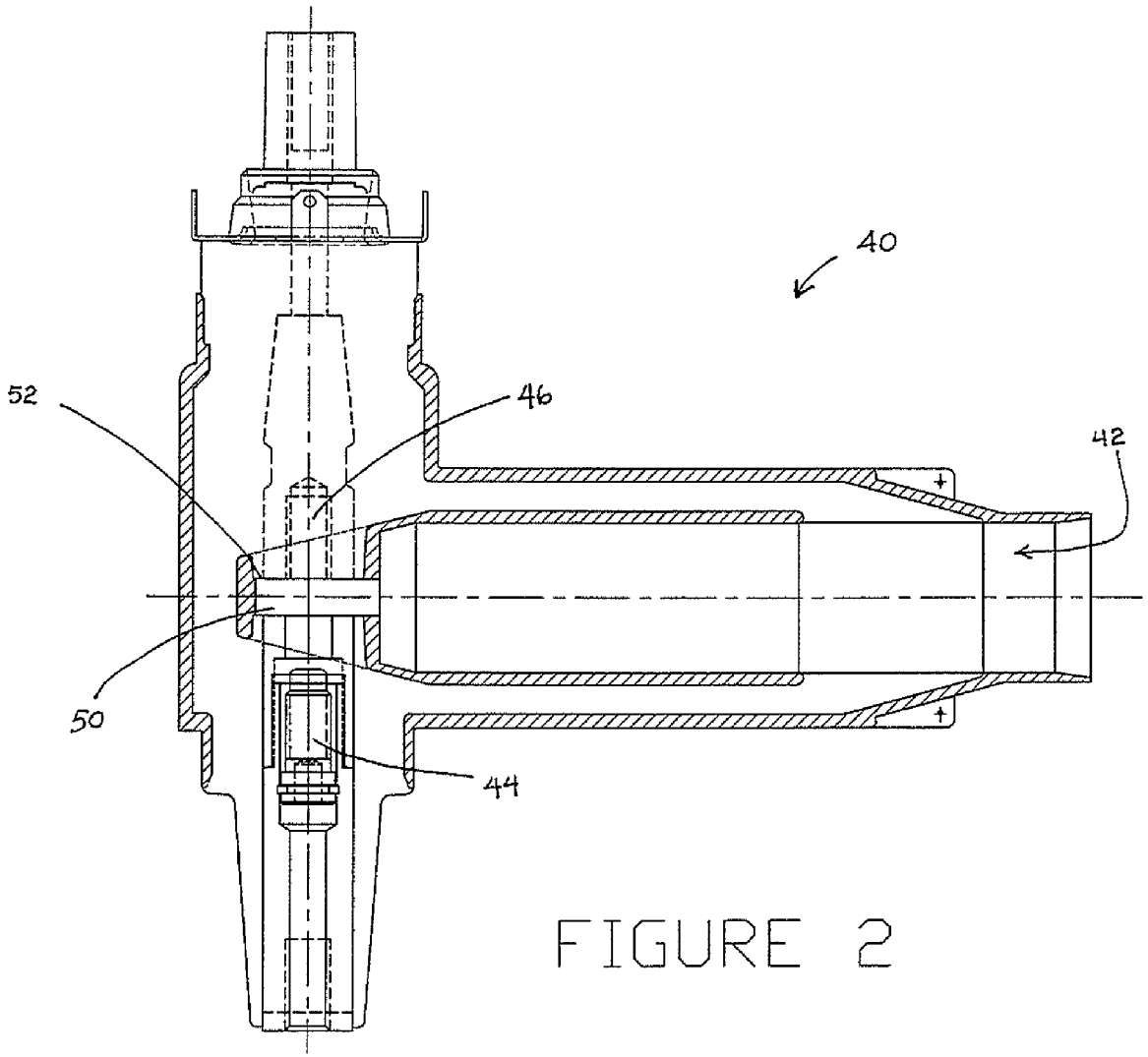
FIG. 2 is a side view of an elbow in accordance with an embodiment of the invention

Referring initially to FIGS. 1-2, certain embodiments of an elbow 10, 40 in accordance with the invention are shown. Elbow 10, 40 can include a bore 12, 42 through which a cable assembly (not shown) can be inserted, the cable assembly preferably having a lug having an aperture therein. Elbow 10, 40 can electrically connect one or more devices, such as a transformer, high voltage switch, etc. to the cable.

The portion of the lug having the aperture is preferably inserted into a cavity 20, 50 of elbow 10, 40, more preferably until the aperture is aligned with a stud 14, 44 and receiving cavity 16, 46. Stud 14, 44 and receiving cavity 16, 46 can be integral with elbow 10, 40, for example, molded into elbow 10, 40, or alternatively stud 14, 44 and receiving cavity 16, 46 can be a part of a device that is inserted into elbow 10, 40.

In the embodiments shown, cavity 20, 50 includes an extension 22, 52 that extends beyond the inner wall of elbow 10, 40. This extension 22, 52 is preferably shaped and sized to receive at least a portion of an impedance assembly, certain embodiments of which are described below.

Figures 3, 4, 5, 6:
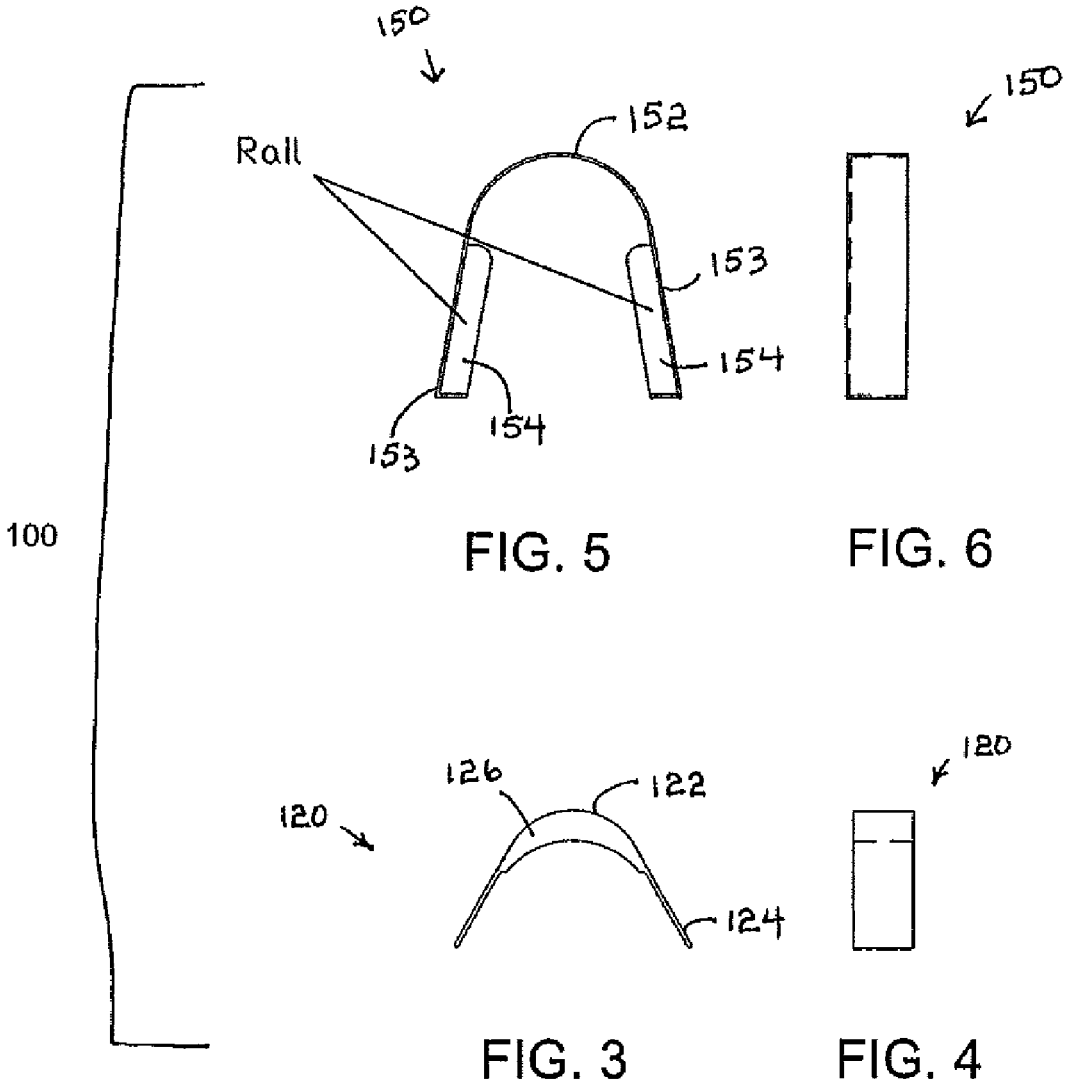
FIG. 3 is a top view of an impedance member in accordance with an embodiment of the invention.
FIG. 4 is a front view of the impedance member of FIG. 3.
FIG. 5 is a top view of a guide member in accordance with an embodiment of the invention.
FIG. 6 is a front view of the guide member of FIG. 5.
Figure 7:
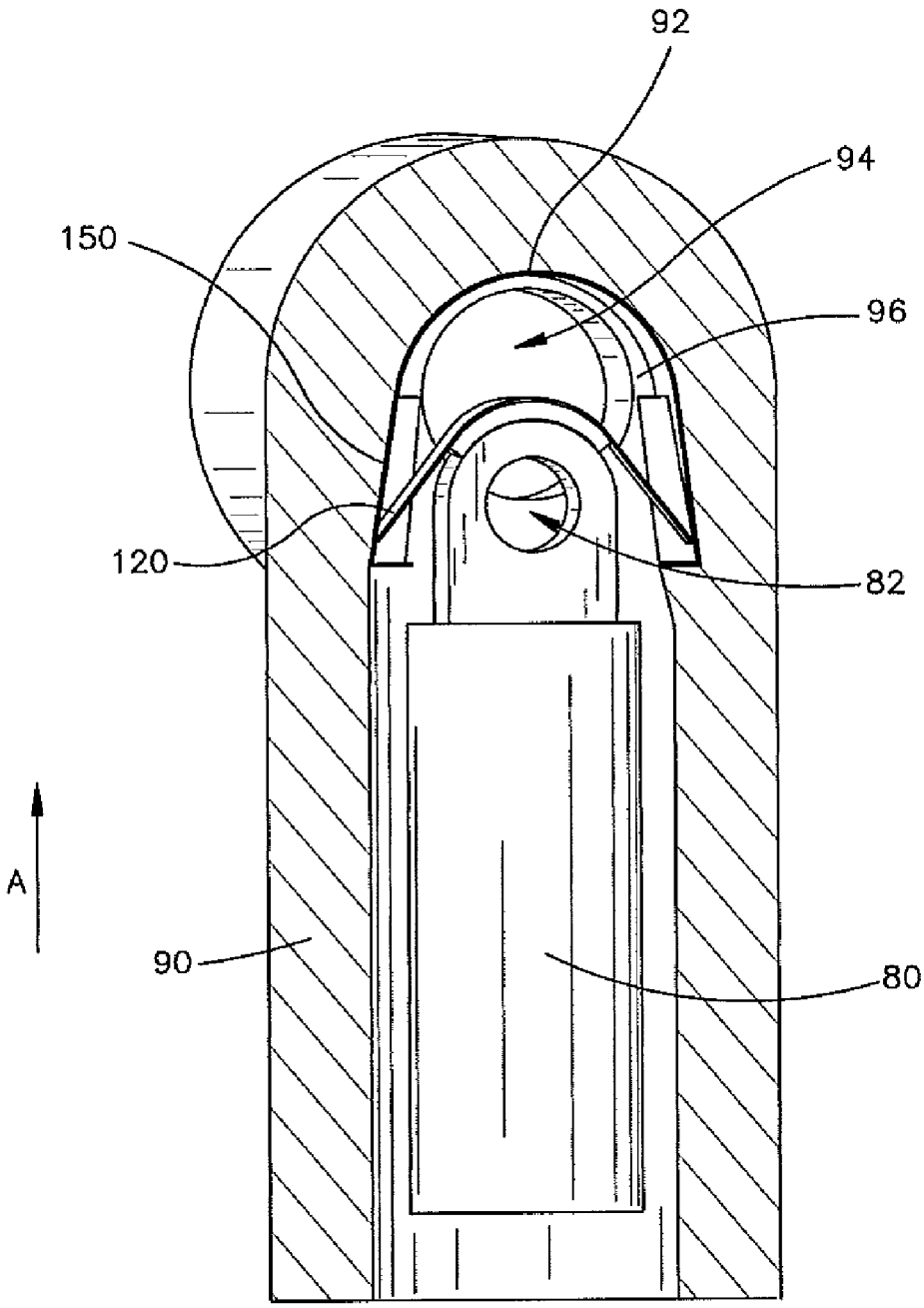
FIG. 7 is a sectional perspective view of an elbow and impedance assembly in accordance with an embodiment of the invention.
Figure 8:
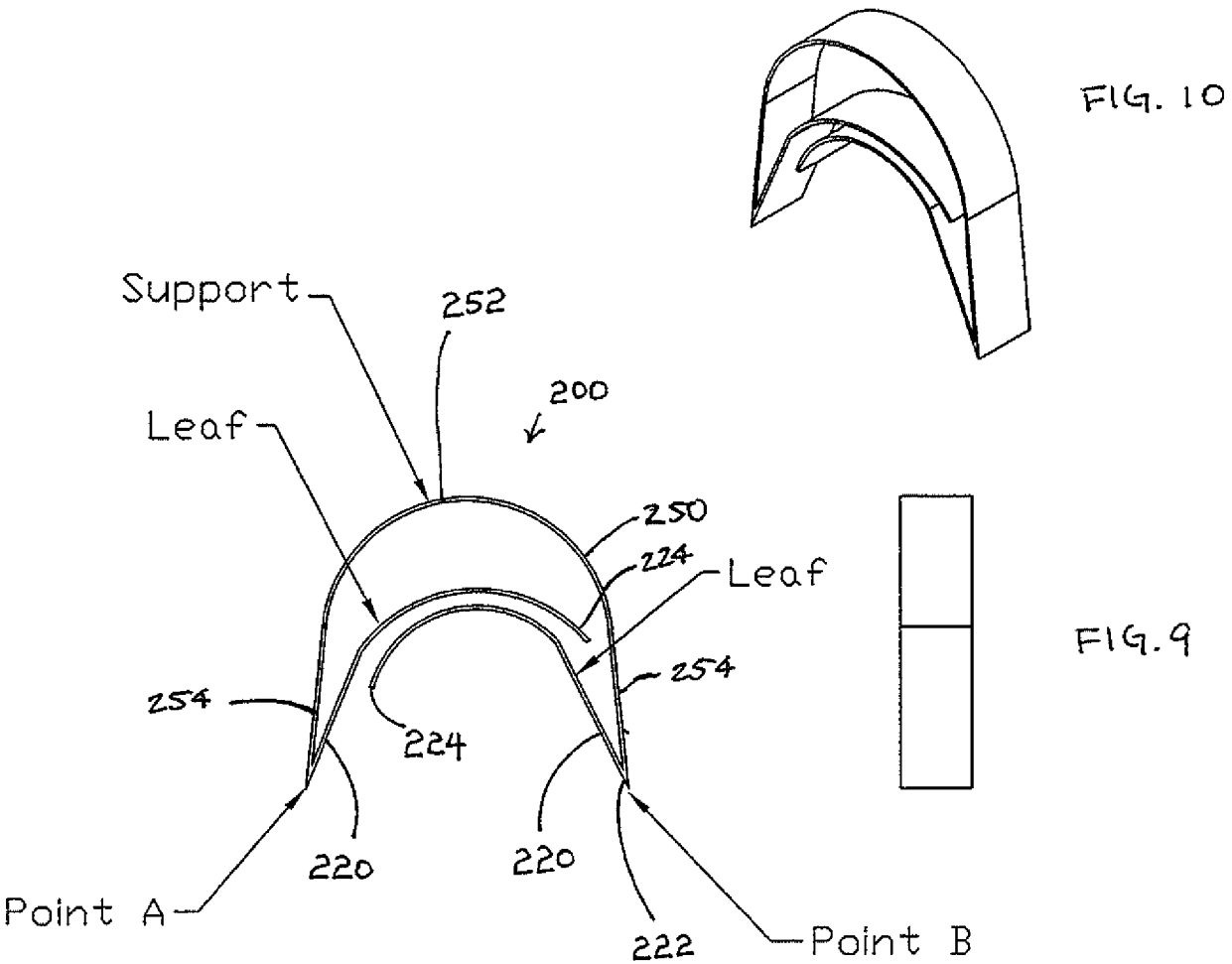
FIG. 8 is a top view of an impedance assembly in accordance with an embodiment of the invention.

FIGS. 3-7 illustrate an embodiment of an impedance assembly 100 having an impedance member 120 and a guide member 150. In FIGS. 5-6, an embodiment of guide member 150 is shown. Preferably, guide member 150 can be positioned within cavity 20, 50 of elbow 10, 40 such that a portion thereof is located within extension 22, 52 of cavity 20, 50. Guide member 150 preferably has a guide curved portion 152 and one or more, preferably two, guide legs 153 extending therefrom. Curved portion 152 preferably conforms to the shape of the inner wall of extension 22, 52 and cavity 20, 50, as shown in FIG. 7. It is understood that if the inner wall of extension 22, 52 and cavity 20, 50 were to be angular, undulated, etc., it may be preferred for guide curved portion 152 to have a corresponding angular, undulated, etc. shape to enhance the fit between guide member 150 and elbow 10, 40. Guide legs 153 preferably include one or more rails 154 extending inward on which impedance member 120 can slide or otherwise move in a controlled path.

Referring to FIGS. 3-4, impedance member 120 can include an impedance curved portion 122 having a shape generally corresponding to the guide curved portion 152 of guide member 150. Impedance member 120 can also include one or more, preferably two, impedance legs 124 constructed and arranged to contact the inner wall of guide legs 153 and rails 154. Preferably, impedance legs 124 are flexible and can be displaced toward and away from each other. In the embodiment shown, impedance legs 124 are urged outward, such that the ends of impedance legs 124 contact and apply a pressure on the inner walls of guide legs 153. The pressure between impedance legs 124 and guide legs 153 is preferably greater proximate guide curved portion 152. Therefore, impedance member 120 is urged away from guide curved portion 152 and toward guide legs 153 in the absence of external pressure.

FIG. 7 shows an embodiment of impedance assembly 100 within an elbow 90. As shown, when lug 80 is not completely inserted into cavity 96, impedance member 120 blocks aperture 94 of elbow 90, thus preventing the stud from being inserted into proper alignment with aperture 94.

In the embodiment shown in FIG. 3, impedance member 120 includes a panel 126 extending from impedance curved portion 122 toward impedance legs 124. Panel 126 preferably increases the surface area covered by impedance member 120 in cavity 20, 50 of elbow 10, 40, which can improve the impedance of stud 14, 44 into receiving cavity 16, 46 without passing through the aperture of the lug.

During installation, lug 80 can be displaced in direction A as seen in FIG. 7, thus pushing impedance member 120 in direction A, and impedance legs 124 can slide along rails 154 of guide member 150 until panel 126 clears aperture 94 and enters extension 92. Preferably, impedance curved portion 122 contacts the inner surface of guide curved portion 152, thus preventing lug 80 from being inserted too far. Thus proper alignment of aperture 94 of elbow 90 and lug aperture 82 can be facilitated. Preferably, impedance member 120, more particularly impedance legs 124, are flexible enough so that once impedance member 120 is displaced by lug 80, the pressure applied by impedance member 120 on lug 80 is insufficient to push lug 80 out once lug 80 is properly installed, or present a false sense of proper installation to the installer by providing resistance.

Figure 11:
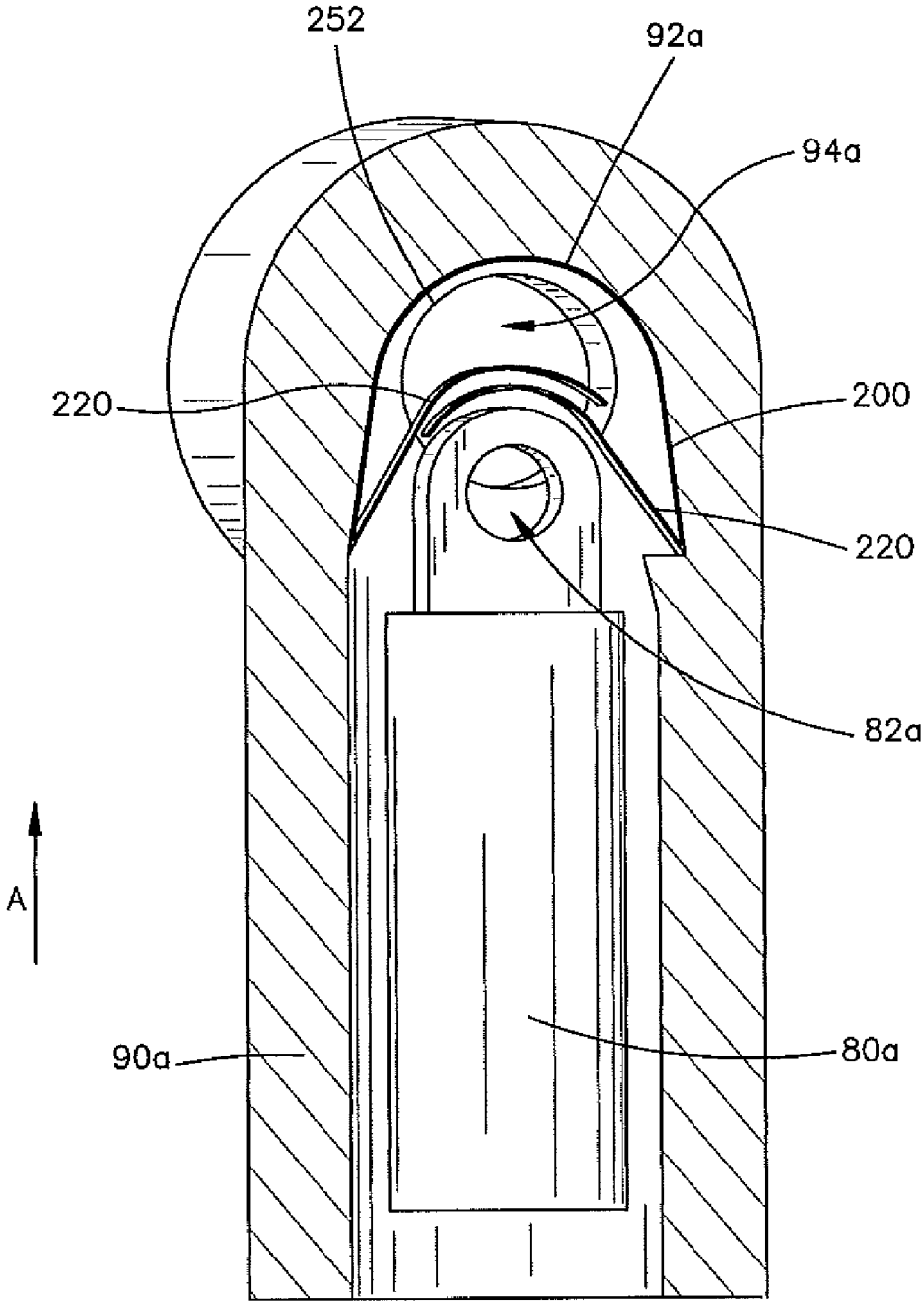
FIG. 11 is a sectional perspective view of an elbow and impedance assembly in accordance with an embodiment of the invention.

Another embodiment of an impedance assembly is illustrated in FIGS. 8-11. Rather than providing separate guide and impedance members, the embodiment shown provides an impedance assembly generally indicated as 200 having one or more, preferably two, impedance members 220 connected to a support 250. In the embodiment shown, support 250 has a generally curved portion 252 and legs 254 extending therefrom. Referring to FIG. 11, curved portion 252 has a curvature generally corresponding to the curvature of the inner wall of an elbow and is positioned at least partially within extension 92*a*, preferably flushed therewith.

In the embodiment shown in FIGS. 8-11, two impedance members 220 extend inward from support 250, preferably overlapping at least partially. As shown, impedance members 220 include a fixed end 222 attached to support 250, and a movable end 224 that is not attached to support 250. Accordingly, as lug 80*a* is inserted into elbow 90*a* in direction A as seen in FIG. 11, lug 80*a* can push and displace impedance members 220, more specifically, displace movable ends 224 in direction A. Preferably, impedance members 220 are constructed such that they are urged away from curved portion 252 of support 250 in the absence of external pressure. Therefore, the rest position of impedance members 220 is preferably within elbow aperture 94*a* of elbow 90*a*, thus hindering a stud from being inserted into elbow aperture 94*a* unless impedance members 220 are displaced.

Referring to FIGS. 8-11, two impedance members 220 can be provided, each extending from opposite sides of support 250 extend inward, thus obstructing elbow aperture 94*a*. In accordance with an embodiment of the invention, as lug 80*a* is moved in direction A as seen in FIG. 11, lug 80*a* pushes impedance members 220, thus displacing them. More specifically, movable ends 224 can be displaced in direction A, thus pivoting impedance members 220 toward legs 254 of support 250 until impedance members 220 contacts support 250 and cannot be displaced further. When such a position is reached, lug 80*a* is preferably properly positioned within elbow 90*a*, and lug aperture 82*a* is properly aligned with elbow aperture 94*a*.

Figure 12:
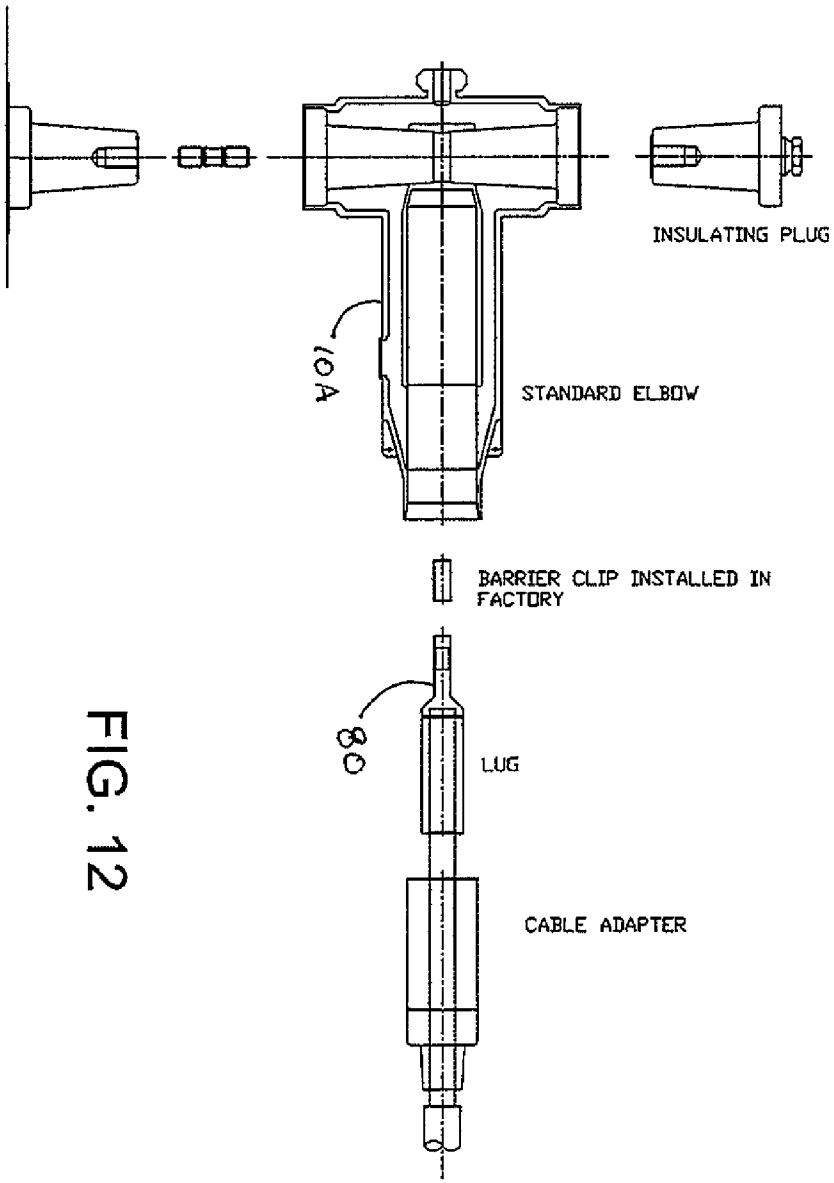
FIG. 12 is an exploded front view of an elbow, impedance assembly and cable assembly in accordance with an embodiment of the invention.

Referring to FIG. 12, a standard elbow 10A can receive an impedance assembly 100, 200 without having an extension 22, 52 in cavity 20, 50. Rather, impedance assembly 100, 200 can be molded in, inserted, or otherwise installed in a standard elbow 10A. Preferably, impedance assembly 100, 200 is thin enough such that it does not interfere with the proper positioning of lug 80 within standard elbow 10A.

Figure 13:
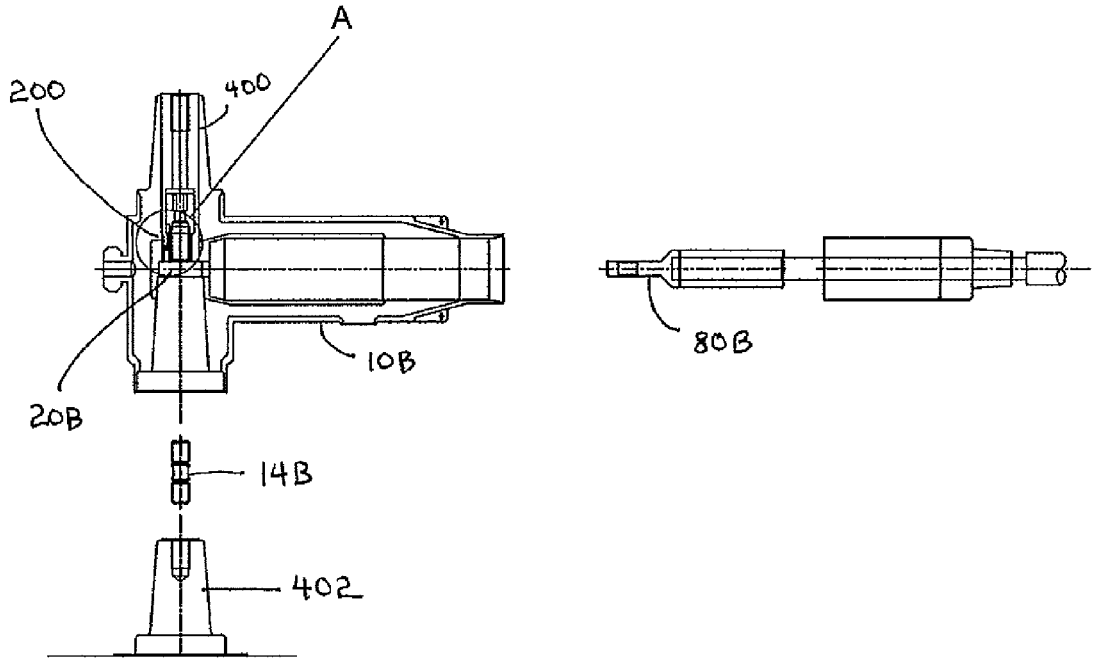
FIG. 13 is an exploded front view of an elbow, impedance assembly and cable assembly in accordance with an embodiment of the invention.
Figure 14:
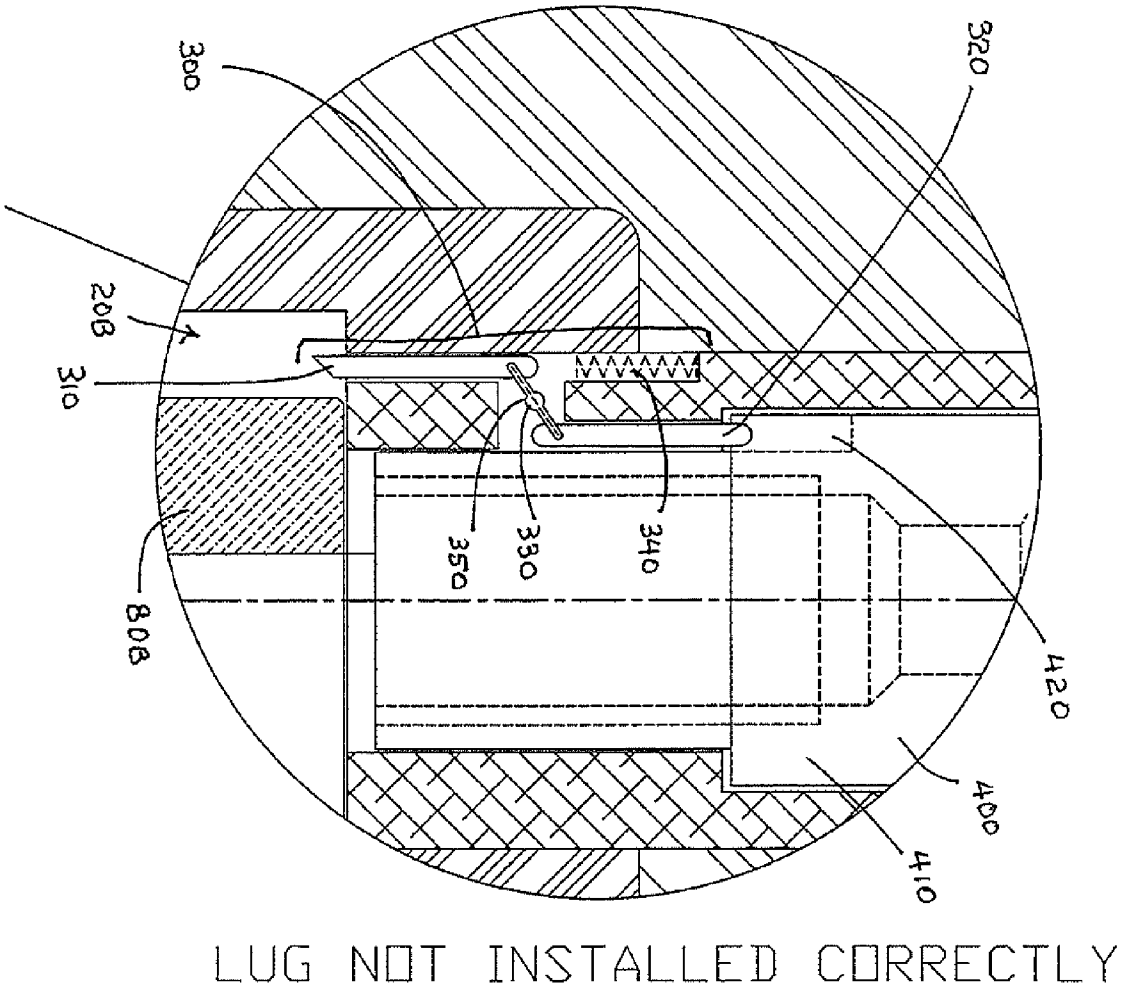
FIG. 14 is a magnified view of section A of FIG. 13 showing an impedance assembly in a first position.
Figure 15:
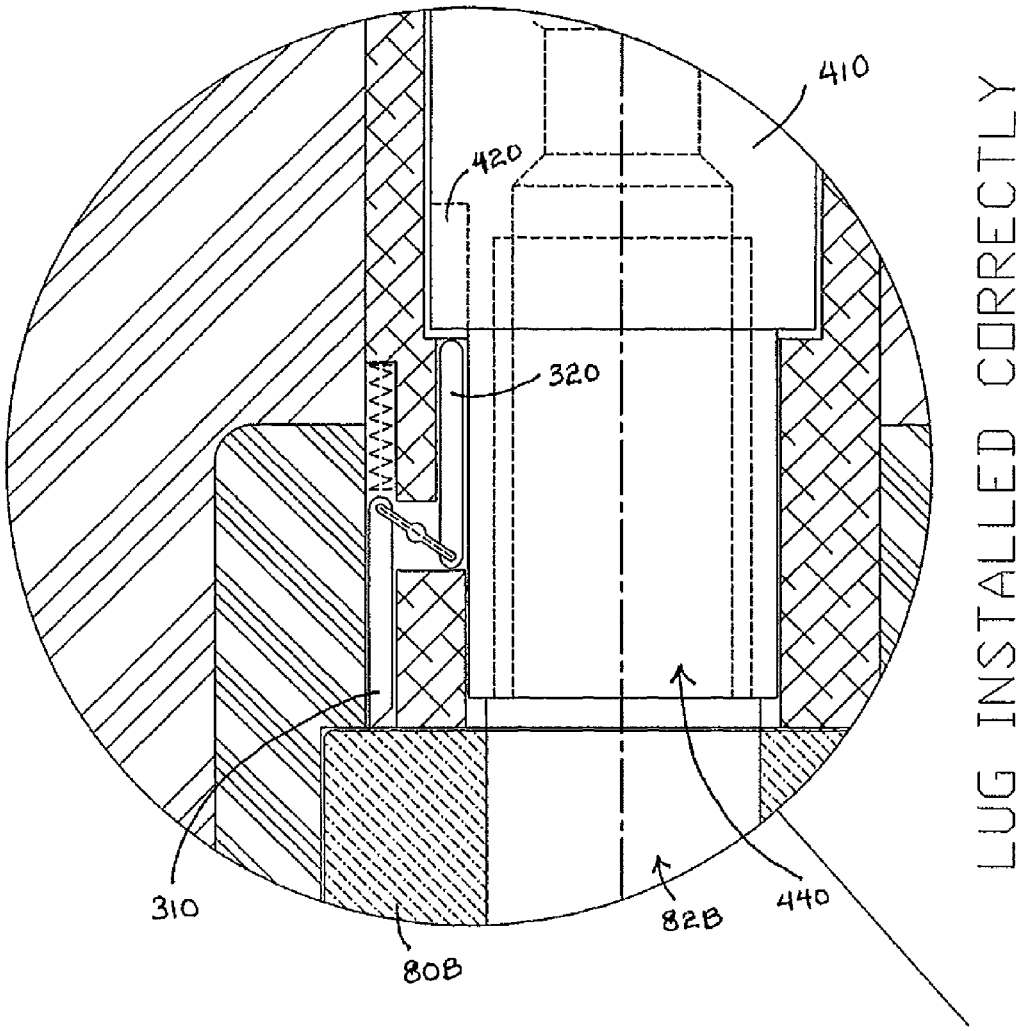
FIG. 15 is a magnified view of section A of FIG. 13 showing an impedance assembly in an alternate position.

FIGS. 13-15 illustrate an alternate embodiment of impedance assembly 300 that is provided within elbow 10B, more preferably within a wall of elbow 10B. As shown, impedance assembly 300 can include a displacement member 310 pivotally connected to an impedance member 320 via a pivoting rod 330, which preferably pivots about a pivot point 350. Referring to FIG. 14, impedance member 320 can extend partially within or proximate a mating device 400, for example, a rotatable female threaded device. Preferably, device 400 includes a receiving cavity 420 within a rotating member 410. During installation, rotating member 410 is preferably rotated to threadingly engage and receive a threaded stud or other connecting device, as shown in FIG. 13.

FIG. 14 shows an exemplary arrangement of an embodiment of impedance assembly 300 in an impedance position, wherein device 400 is prevented from rotating. More specifically, impedance member 320 extends within cavity 420 of rotating member 410 of device 400. Cavity 420 can be sized and shaped such that rotating member 410 is prevented from rotating enough to complete installation when impedance member 320 extends within cavity 420. Preferably, when impedance member 320 extends within cavity 420, rotating member 410 is prevented from rotating more than a nominal amount, and more preferably cannot rotate at all. Whereas cavity 420 is described herein as a cavity for receiving impedance member 320, cavity rotating member 410 can include a cut out, projection, etc. constructed and arranged to prevent the rotation of rotating member 410 when impedance member 320 extends toward rotating member 410.

The impedance position is preferably the default position of impedance assembly 300. By way of non-limiting example, a spring 340 can urge displacement member 310 toward cavity 20B such that impedance member 320 is urged toward and into cavity 420 of rotating member 410. Thus in the default rest position, rotating member 410 is prevented from rotating when lug 80B is not installed properly. It is to be understood that spring 340 can urge impedance member 320 or alternate devices and methods of making the impedance position the default position can be provided without deviating from the scope of the invention.

Once lug 80B is installed properly, lug SOB can move displacement member 310 away from lug 80B and toward spring 340. Therefore, as displacement member 310 moves toward spring 340, rod 330 can pivot about pivot point 350, thus moving impedance member 320 out of cavity 420 and away from rotating member 410. FIG. 15 illustrates an embodiment of impedance assembly 300 in a retracted position. As can be seen, impedance member 320 clears rotating member 410 of device 400, and thus rotating member 410 is free to rotate. Preferably, lug aperture 82B of lug 80B is aligned with the receiving cavity 440 of device 400 for receiving stud 14B. Therefore, stud 30 can properly be inserted through lug aperture 82B and into receiving cavity 440 of device 400 to connect lug 80B, elbow 10B, device 400 and second device 402.

Additionally, the embodiments of the termination system illustrated herein preferably includes an elbow, or generally T-shaped housings containing two perpendicular bores. However, it is understood that other housing configurations are contemplated and may be used with the present invention. For example, housings containing more than two bores and/or bores that are not perpendicular may be used. Other housing configurations include, but are not limited to, Y-shaped, L-shaped, X-shaped, vault stretchers, and other disconnectable joints utilizing single and/or stacked elbows, such as 600 Amp elbows. The Y-shaped housing is a good example of a housing containing three non-perpendicular bores. Additionally, device 400 or second device 402 can be formed separately and inserted or molded integrally into elbow 10B without deviating from the scope of the invention.

The examples provided are merely exemplary, as a matter of application specific to design choice, and should not be construed to limit the scope of the invention in any way. Thus, while there have been shown and described and pointed out novel features of the present invention as applied to preferred embodiments thereof, it will be understood that various omissions and substitutions and changes in the form and details of the disclosed invention may be made by those skilled in the art without departing from the spirit of the invention. For example, the shape of the impedance members, support, guide, extension, etc. as well as the arrangements thereof, can be changed without deviating from the scope of the invention as a matter of application specific to design choice. Additionally, other alterations can be made, as a way of non-limiting example, the number of impedance members, thickness thereof, the angle or manner in which the impedance members contact the support or guide member, etc. as a matter of application specific to design choice, without deviating from the scope of the invention. It is the intention, therefore, to be limited only as indicated by the scope of the claims appended hereto.

It is also to be understood that the following claims are intended to cover all of the generic and specific features of the invention herein described and all statements of the scope of the invention which, as a matter of language, might be said to fall therebetween.

We claim:

1. A termination assembly comprising:

a termination device having a receiving cavity for receiving a lug having a lug aperture;

a stud displaceable between a retracted position and an extended position; and an impedance assembly having an impedance member constructed and arranged to be displaceable from an impeding position to a cleared position by the displacement of the lug into the receiving cavity;

wherein the stud is not aligned with the lug aperture when the impedance member is in the impeding position, such that the stud is prevented from being displaced into the extended position; and wherein the stud is aligned with the lug aperture when the impedance member is in the cleared position, such that the stud is displaceable through the lug aperture into the extended position.

2. The termination assembly of claim 1, wherein the impedance assembly includes a guide member constructed and arranged to support the impedance member and to guide the displacement of the impedance member between the impeding position and the cleared position.

3. The termination assembly of claim 1, wherein the impedance member includes a panel and a plurality of legs extending from the panel.

4. The termination assembly of claim 3, wherein the impedance assembly includes a guide member having a rail along which the legs of the impedance member can travel as the impedance member is displaced between the impeding position and the cleared position.

5. The termination assembly of claim 4, wherein the guide member includes a narrow end and a wide end, wherein the impedance member is displaced from the wide end to the narrow end as the impedance member is displaced from the impeding position to the cleared position; wherein the impedance member is constructed and arranged such that the legs are urged outward in the absence of a force pinching the legs inward.

6. The termination assembly of claim 1, wherein the impedance assembly includes a frame positioned within the receiving cavity, the frame being connected to the impedance member being displaceable toward and away from the frame, wherein the impedance member is urged away from the frame.

7. The termination assembly of claim 1, wherein the impedance assembly includes a frame positioned within the receiving cavity and two or more impedance members displaceable toward and away from the frame.

8. An impedance assembly comprising:

a base constructed and arranged to be received within a receiving cavity of a termination device;

an impedance member constructed and arranged to be displaceable from an impeding position to a cleared position;

wherein the impedance member prevents a stud from being extended into the receiving cavity when the impedance member is in the impeding position; and wherein the stud is free to extend into the receiving cavity when the impedance member is in the cleared position.

9. The impedance assembly of claim 8, wherein the base comprises a rail along which the impedance member can travel as the impedance member is displaced between the impeding position and the cleared position.

10. The impedance assembly of claim 8, wherein the base comprises a frame connected to the impedance member, the impedance member being displaceable radially outward toward the frame.

11. The impedance assembly of claim 10, wherein the impedance member includes two displaceable members urged radially inward away from the frame in the absence of a force urging the displaceable members radially outward toward the frame.

* * * * *